United States Patent [19]

Culp

[11] Patent Number: 5,035,208

[45] Date of Patent: Jul. 30, 1991

[54] METHOD AND DEVICE FOR WINTERIZING BOAT ENGINES

[76] Inventor: Edwin C. Culp, 9 Severn Dr., Annapolis, Md. 21401

[21] Appl. No.: 380,440

[22] Filed: Jul. 17, 1989

[51] Int. Cl.[5] ..... F01P 11/02

[52] U.S. Cl. ..... 123/41.14; 134/95; 134/169 A; 134/26

[58] Field of Search ..... 123/41.14; 165/95; 134/22, 19, 26, 95, 98, 169 A

[56] References Cited

U.S. PATENT DOCUMENTS

| | | | |
|---|---|---|---|
| 1,962,932 | 6/1934 | Mather, Jr. | 123/174 |
| 4,083,399 | 4/1978 | Babish et al. | 165/95 |
| 4,121,948 | 10/1978 | Guhlin | 134/169 A |
| 4,161,979 | 7/1979 | Stearns | 165/99 |
| 4,176,708 | 12/1979 | Joffe | 123/41.01 |
| 4,271,874 | 6/1981 | Brody | 141/1 |
| 4,791,890 | 12/1988 | Miles et al. | 123/41.14 |
| 4,911,211 | 3/1990 | Anderson | 123/41.14 |
| 4,925,495 | 5/1990 | Crisp et al. | 134/95 |

*Primary Examiner*—Noah P. Kamen

*Attorney, Agent, or Firm*—Semmes, Bowen & Semmes

[57] ABSTRACT

A system for winterizing boat engines includes a "Y" valve having stop cocks located on the common duct and each arm. One arm is connected to a source of flushing liquid, and the other to a source of anti-freeze. The common duct is connected to the engine.

18 Claims, No Drawings

METHOD AND DEVICE FOR WINTERIZING BOAT ENGINES

TECHNICAL FIELD OF THE INVENTION

The present invention has its most important application to winterizing small boat engines quickly and efficiently to prevent engine damage due to cold weather.

BACKGROUND OF THE INVENTION

Currently, boat engines are generally winterized by removing the plugs in the engine block and manifolds and allowing the engine to drain passively, then replacing the plugs and pouring antifreeze into the manifold until the engine is full of antifreeze. This process takes approximately one hour. Utilizing the invention described herein reduces the time required to winterize a typical engine for a pleasure boat to approximately ten minutes. Furthermore, the system I have devised allows the operator to control the entire process from inside the boat. Methods currently in use require the operator to get in and out of the boat during the process. Finally, the system I have devised may be used to winterize inboard engines as well as outboard engines and inboard/outboard engines without taking the boat out of the water as the entire system can be contained on board the vessel. In short, the system I have devised is quicker, easier, and more efficient than the winterizing systems currently in use.

SUMMARY OF THE INVENTION

The winterizing system I have devised first flushes and cleans the engine by forcing a flushing liquid, either water or a chemical cleaner through the engine, then quickly fills the engine with the optimal amount of antifreeze. A "Y" valve is utilized to shift from the flush mode to the fill mode, directing first a flushing liquid, then a measured amount of antifreeze into the engine intake. With the "Y" valve set so as to permit the flushing liquid to flow from its source to the engine intake, the flushing liquid is forced through the engine while the engine is running, flushing and cleaning the engine. The flushing liquid is propelled either by water pressure if the source is a faucet or gravity if the source is a tank of liquid. When the engine has warmed up and is thoroughly flushed, the "Y" valve is closed to the source of flushing liquid and opened to the antifreeze from a bucket or other container, which is situated higher than the engine, typically on the swim platform or stern of the boat. This container holds a pre-measured amount of antifreeze, the exact amount of which will vary according to the size and requirements of different engines. When the "Y" valve is set to permit flow of antifreeze from the bucket to the outdrive intake port, a combination of gravity and the suction created by the outdrive water pump causes the container to empty into the engine. When the container is empty, the engine is completely winterized.

DESCRIPTION OF EXEMPLARY FORMS OF THE INVENTION

The preferred mode of the invention utilizes a garden hose attached to a faucet, providing fresh water as the flushing liquid. Other sources of fresh water, such as on-board tanks may be utilized, and flushing liquids other than water, such as chemical cleaners may also be utilized. When the system is used in connection with an inboard engine, the intake is accessed by means of a T-valve on the through-hull water pickup hose, rather than by use of flush muffs. The source of the antifreeze in the preferred mode of the invention is simply a five gallon bucket with an outlet in the base, although other containers may be substituted. The hoses through which the antifreeze flows should be made of clear plastic so that it is easy to ascertain when the antifreeze has been fully taken in by the engine. The single valve, "Y" valve and flush muffs are all standard, readily available items.

I claim:

1. A device for winterizing boat engines with an intake port, comprising:

(a) a source of flushing liquid;

(b) a means for regulating the flow of the flushing liquid at said source;

(c) a container for holding antifreeze at a higher elevation than the engine to be winterized;

(d) a first stop cock fixed to the base of said container for regulating flow of antifreeze out of the container;

(e) a "Y" valve having two arms and a common duct;

(f) a hose connecting said first stop cock to one arm of "Y" valve;

(g) a hose connecting the source of flushing liquid to the other arm of the "Y" valve;

(h) additional stop cocks on each arm of the "Y" valve to regulate the flow through each arm independently;

(i) a hose means adapted to connect the common duct of the "Y" valve to the intake port of the engine to be winterized.

2. The device described in claim 1 wherein the hose connecting the first stop cock to the "Y" valve to permit the flow of antifreeze and the hose connecting the common duct of the "Y" valve to the intake port of the engine are made of clear plastic.

3. The device described in claim 1 wherein the container for antifreeze is a bucket with a capacity between three and seven gallons.

4. The device described in claim 1 wherein the flushing liquid is water.

5. The device described in claim 1 wherein the flushing liquid is a chemical cleaner.

6. The device described in claim 1 wherein the flushing liquid is stored in a tank means adapted to be located at a higher elevation than the boat engine.

7. The device described in claim 1 wherein the source of flushing liquid is a water faucet.

8. The device describe in claim 1 where the hose means adapted to connect the common duct of the "Y" valve to the intake port is attached to the intake port by means of flush muffs, which are a type of removable clamp.

9. The device described in claim 1 for use in inboard engines with a through-hull water intake, additionally comprising a "T" valve on the through hull water intake, and the common duct of the "Y" valve being adapted to be connected to the "T" valve.

10. The process of winterizing a boat engine utilizing the device described in claim 1 by first flushing the boat engine with the flushing liquid and then filling the boat engine with a pre-measured amount of antifreeze.

11. The process of winterizing a boat engine utilizing the device described in claim 2 by first flushing the boat engine with the flushing liquid and then filling the boat engine with a pre-measured amount of antifreeze.

12. The process of winterizing a boat engine utilizing the device described in claim 3 by first flushing the boat engine with the flushing liquid and then filling the boat engine with a pre-measured amount of antifreeze.

13. The process of winterizing a boat engine utilizing the device described in claim 4 by first flushing the boat engine with water and then filling the boat engine with a pre-measured amount of antifreeze.

14. The process of winterizing a boat engine utilizing the device described in claim 5 by first flushing the boat engine with a chemical cleaner and then filling the boat engine with a pre-measured amount of antifreeze.

15. The process of winterizing a boat engine utilizing the device described in claim 6 by first flushing the boat engine with the flushing liquid and then filling the boat engine with a pre-measured amount of antifreeze.

16. The process of winterizing a boat engine utilizing the device described in claim 7 by first flushing the boat engine with the flushing liquid and then filling the boat engine with a pre-measured amount of antifreeze.

17. The process of winterizing a boat engine utilizing the device described in claim 8 by first flushing the boat engine with the flushing liquid and then filling the boat engine with a pre-measured amount of antifreeze.

18. The process of winterizing a boat engine utilizing the device described in claim 9 by first flushing the boat engine with the flushing liquid and then filling the boat engine with a pre-measured amount of antifreeze.

* * * * *